US005187825A

United States Patent [19]

Tesch

[11] Patent Number: 5,187,825

[45] Date of Patent: Feb. 23, 1993

[54] QUILTED BED BLANKET

[76] Inventor: Gunter Tesch, Avenue Jean-Marie-Musy 15, Fribourg, Switzerland, CH-1700

[21] Appl. No.: 415,289

[22] PCT Filed: Oct. 26, 1988

[86] PCT No.: PCT/EP88/00964

§ 371 Date: Oct. 31, 1989

§ 102(e) Date: Oct. 31, 1989

[87] PCT Pub. No.: WO89/06508

PCT Pub. Date: Jul. 27, 1989

[30] Foreign Application Priority Data

Jan. 12, 1988 [CH] Switzerland ..... 84/88

[51] Int. Cl.[5] ..... A47G 9/02

[52] U.S. Cl. ..... 5/502; 5/486; 5/482

[58] Field of Search ..... 5/482, 485, 486, 502; 112/140

[56] References Cited

U.S. PATENT DOCUMENTS

| | | | |
|---|---|---|---|
| 799,763 | 9/1905 | Steiner | 5/502 |
| 966,634 | 8/1910 | Wolfe | 5/502 |
| 2,087,505 | 7/1937 | Davis | 5/502 |
| 2,248,768 | 7/1941 | Licht | 5/485 |
| 4,618,531 | 10/1986 | Marcus . | |
| 4,707,873 | 11/1987 | A-Yan | 5/502 |
| 4,962,554 | 10/1990 | Tesch | 5/502 |

FOREIGN PATENT DOCUMENTS

| | | | |
|---|---|---|---|
| 0006247 | 1/1980 | European Pat. Off. . | |
| 491524 | 2/1930 | Fed. Rep. of Germany . | |
| 8704127 | 2/1930 | Fed. Rep. of Germany . | |
| 693613 | 7/1940 | Fed. Rep. of Germany . | |
| 817638 | 10/1951 | Fed. Rep. of Germany . | |
| 906501 | 3/1954 | Fed. Rep. of Germany . | |
| 1948172 | 3/1971 | Fed. Rep. of Germany . | |
| 2602706 | 2/1977 | Fed. Rep. of Germany . | |
| 7634526 | 2/1977 | Fed. Rep. of Germany . | |
| 3147023 | 6/1983 | Fed. Rep. of Germany | 5/485 |
| 658177 | 10/1986 | Switzerland . | |
| 2139492 | 11/1984 | United Kingdom | 5/502 |

*Primary Examiner*—Michael F. Trettel
*Attorney, Agent, or Firm*—Bacon & Thomas

[57] ABSTRACT

A quilted blanket (1) with a preferably rectangular covering and a loosely packed filling is described. The covering has at least one closable opening through which it can be filled with filling material. So that this blanket (1) can be used both as a so-called summer blanket and as a so-called winter blanket and so that it can be easily filled and emptied, particularly partially filled and emptied, the filling material comprises loosely packed filling material such as aggregates of spherically wrapped fibres. The opening of the covering can be closed by means of an easily openable fastener, such as a zipper, VELCRO tape, adhesive tape or by the like, or means of buttons.

9 Claims, 2 Drawing Sheets

QUILTED BED BLANKET

BACKGROUND OF THE INVENTION

Blankets, particularly quilts, should protect the human body. They create a zone between the body and the surrounding air which impedes an exchange of heat between the body and the surroundings and thereby reduces the radiation of heat from the human body, thereby preventing an undercooling of the resting body.

Depending on the ambient temperature, it may be desired that more or less of the heat produced by the human body escape through the blanket. If the ambient temperature is low and the heat gradient is thus relatively high, as for example in the winter, then the blanket should retain as much of the heat produced by the body as possible. If, on the other hand, the ambient temperature is relatively high, as for example in the summer, then it may even be desired that as much heat as possible be carried away from the human body.

As a rule, the retention of heat is essentially achieved by providing an immovable air volume above the human body, i.e. the effect is for the most part achieved by a stationary air cushion, whereby use is made of the fact that air has a low coefficient of thermal conduction.

This means that a blanket, in particular a quilt, should allow a transmission of heat that is inversely proportional to the temperature drop. This is not possible with conventional blankets.

It was therefore proposed to use different blankets in the summer than in the winter or fall and spring which is why one speaks of so-called "summer blankets", "winter blankets" and "fall blankets".

"Winter blankets" and "fall blankets" are designed in such a way that if possible there are no thermal bridges. Thus, instead of normal quilting seams, webs are used, which ensure that the top sheet is the same distance, if possible, from the bottom sheet in the area of the stitching as in the area between the stitching. Fall blankets and in particular winter blankets are also fuller or thicker in order to be able to hold as large an air volume as possible. In the summer these blankets are too warm, i.e. heat builds up under the blanket since the heat produced by the person is not carried away due to the low heat conductivity and the relatively low temperature drop in the summer.

"Summer blankets" are very light, and can also have quilting seams forming otherwise undesired thermal bridges. These so-called thermal bridges allow the heat to pass through very easily. If necessary, a summer blanket should also be able to absorb or let through the perspiration given off by the human body.

It has also been proposed to design a quilt as a blanket system such that several individual blankets can be combined into one overall blanket to form one blanket which is thicker in accordance with the individual blankets. However, this blanket is then also correspondingly heavier.

In both known proposals, the use of two blankets is provided, whereby the second blanket must be stored when it is not being used.

A so-called web blanket in which the outer surfaces of the blanket are joined together by means of webs also on the outer edges of the blanket is known from German U-8.704.127.8. The blanket is divided into a plurality of chambers by the inner webs. Closable openings can be provided in at least one such outer web, to allow filling material, which can be down, synthetic filling, wool and the like, to be fed in. The inner webs are designed in part as discontinuous webs in such a way that the openings of the inner webs also permit access to the internal chambers. Since down can also be used as filling material in this blanket, the closures in the outer webs must be designed to be down-proof, i.e. they are sewn shut after the blanket is filled. Once manufacturing of this blanket is finished, its properties are no longer changed. The filling material can be evenly distributed in the blanket through the discontinuous inner webs.

A so-called coffered blanket is known from German A-3 147 023. Here continuous and intersecting inner webs are provided which divide the blanket into a plurality of chambers. It is proposed that continuous easily closable opening devices, such as zippers, be provided essentially over the length of the webs extending in one direction. To replace, empty, and fill the blanket, an edge seam of the blanket is opened and subsequently sewn up so that the cover is down-proof. To fill and empty the blanket, the zippers disposed on the inner webs can be opened and closed.

Thus, filling or emptying the two aforenamed blankets entails a great deal of work, in particular the outside opening of the covering must always be sewn up again.

From German A-491 524 and Swiss A-658 177 blankets are known which have a casing with longitudinal chambers or pockets into which toroidal or square cushions can be inserted or removed. Thus, in the summer, cushions with a different design can be used than in the winter. Both blankets are basically casings for taking up several smaller blanket parts which can also be used separately.

SUMMARY OF THE INVENTION

It is the object of the present invention to provide a blanket, particularly a quilt, with a preferably rectangular covering and a loosely packed filling, wherein the covering has at least one closable opening through which the covering can be filled with filling material and whereby the blanket is quilted, so that it can be used both as a so-called summer blanket and as a so-called winter blanket. The blanket should be easy to fill and empty, and, in particular, partially fill and empty.

This object is attained by the blanket according to the invention in which the filling material comprises aggregates of spherically wrapped fibers, and the opening of the covering can be closed with an easily openable fastener, such as a zipper, VELCRO tape, adhesive fastener and the like or with buttons.

The user of the blanket can thus fill the blanket with more or less filling material and thus adapt the insulating property to his personal requirements in accordance with the prevailing ambient temperatures. Thus, the covering will be filled with more filling material in the winter in order to increase the volume, whereas in the summer the filling volume is reduced in order to thus increase the diathermancy or thermal insulation of the blanket. Thus, the degree of filling of the blanket is changed in accordance with the respective climatic requirements. The filling material should always have approximately the same density, i.e. it should not be compacted by overfilling since, for the most part, only the weight of the blanket is increased by this; the diathermancy is essentially unchanged.

The covering can be opened and closed in the simplest manner in order to remove or fill the blanket. The opening can also be closed, for example, by parts of the covering that are folded inwards.

To simplify filling and emptying on the one hand, and on the other hand to prevent the filling material from escaping, the filling material comprises or consists solely of aggregates of spherically wrapped fibers which adhere slightly to one another, preventing parts of the filling material from escaping unchecked, as can happen with down, after the covering is opened. Thus, smaller metered quantities can be removed or added. The filling material can, however, also contain flocks, foam sticks and the like.

The two sheets of the blanket are advantageously joined together with stitching at points spaced apart from one another. The stitching can be carried out in such a way that the stitching is also through the filling material. For this purpose the blanket casing is filled with filling material evenly distributed in the casing. Stitching is then carried out in known fashion through the filled blanket. Individual parts of the filling material, particularly the aggregates of spherically wrapped fibers, are thereby pierced by the quilting threads.

The stitching forms, for example, a line pattern and can thereby be continuous or discontinuous. The stitching can also be arranged in a pattern over the surface of the blanket or for the most part can merely be in the form of dots. According to a special embodiment at least some of the previously described, various manners of stitching in a blanket can be combined with one another.

It is recommended that a plurality of closable openings be provided, especially in quilts, in particular quilts with bulging or tubular chambers arranged parallel to one another and longitudinally or transversely to the longitudinal sides of the covering. If necessary, an opening may be allocated to each individual chamber. The individual chambers can then also be filled differently. Thus, for example, the foot area can contain substantially more filling material, especially in the winter, than the head area, whereas, for example in the summer, the degree of filling in both areas can be substantially the same but lower. The longitudinal chambers in the center can have a higher degree of filling, especially in the winter, than the outer longitudinal chambers of the blanket.

According to a preferred embodiment of the invention, the closable openings are arranged in the peripheral seam of the blanket. This is not only very advantageous for the manufacture of such a blanket since it can then be manufactured simply and inexpensively, but it also proves itself in practice since in each case there is only a smaller opening and the material to be removed or filled in is to be handled in a narrow opening cross-section. The filling materials described above can be evenly distributed very easily even with a closed opening.

Such a blanket can be manufactured by filling a blanket covering, which comprises two sheets that are merely joined together at their peripheral seam and whereby at least one zipper or the like is sewn in this peripheral seam, with filling material such as aggregates of spherically wrapped fibers and by closing the zipper or the like. The filled blanket is thereafter provided with quilting seams in a pattern over the entire surface. The stitching is advantageously also through the filling material which tends to reduce the thermal bridges otherwise present in the area of the quilting seams.

The stitchings can in part be parallel to one another, thereby forming bulging or tubular chambers. However, stitching only in the form of dots can also be provided, particularly in the center part of the blanket.

The opening or openings are preferably arranged at one longitudinal end of the blanket.

Further particulars and advantages of the invention can be ascertained from the exemplary embodiments described herebelow and shown in the accompanying drawings.

DETAILED DESCRIPTION OF THE INVENTION

Figure 2:
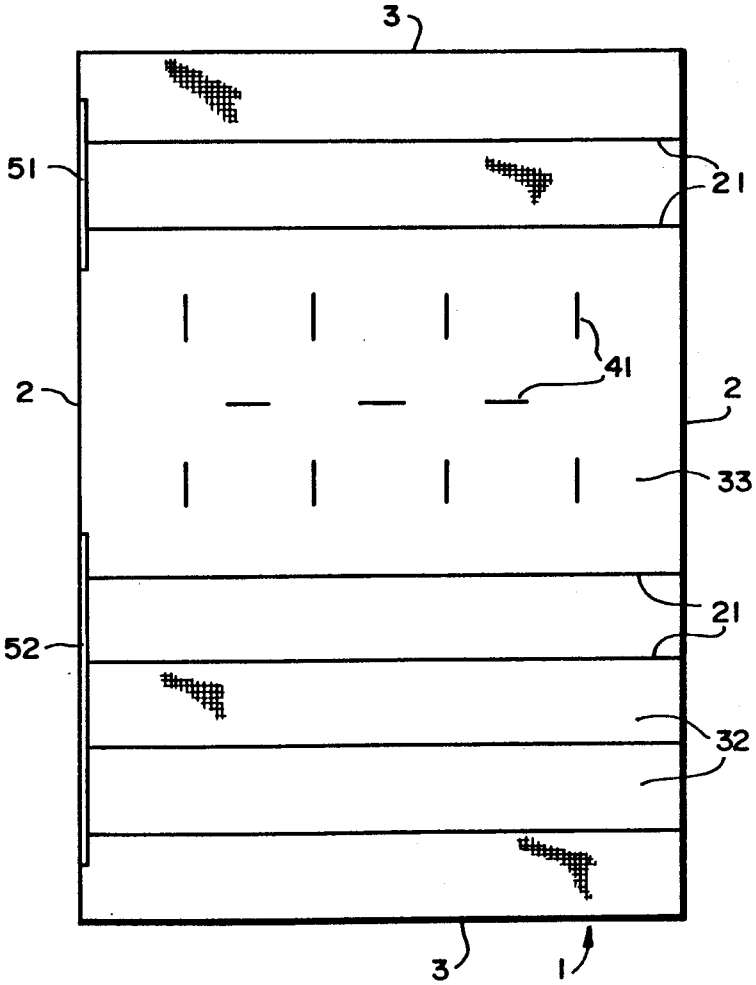
FIG. 2: a top view of a blanket according to a second embodiment.

FIGS. 1 to 4 each illustrate a blanket 1 with a size, for example, of 1.35 m×2 m, i.e. the illustration shows the blankets approximately on a scale of 1:10. These blankets 1 have longitudinal edges 2 and transverse edges 3.

These blankets 1 are divided into different chambers 30 to 38 by different manners of stitching 20 to 23, whereby additional shorter stitchings 40 to 44 are arranged in these chambers 30 to 38. Furthermore, zippers 50 to 54 through which filling material can be added or removed at any time after they are opened are provided in the edges of the blankets. An opening could also be provided such as along line 25 which would be closed by folding over the corner of blanket 1.

Figure 1:
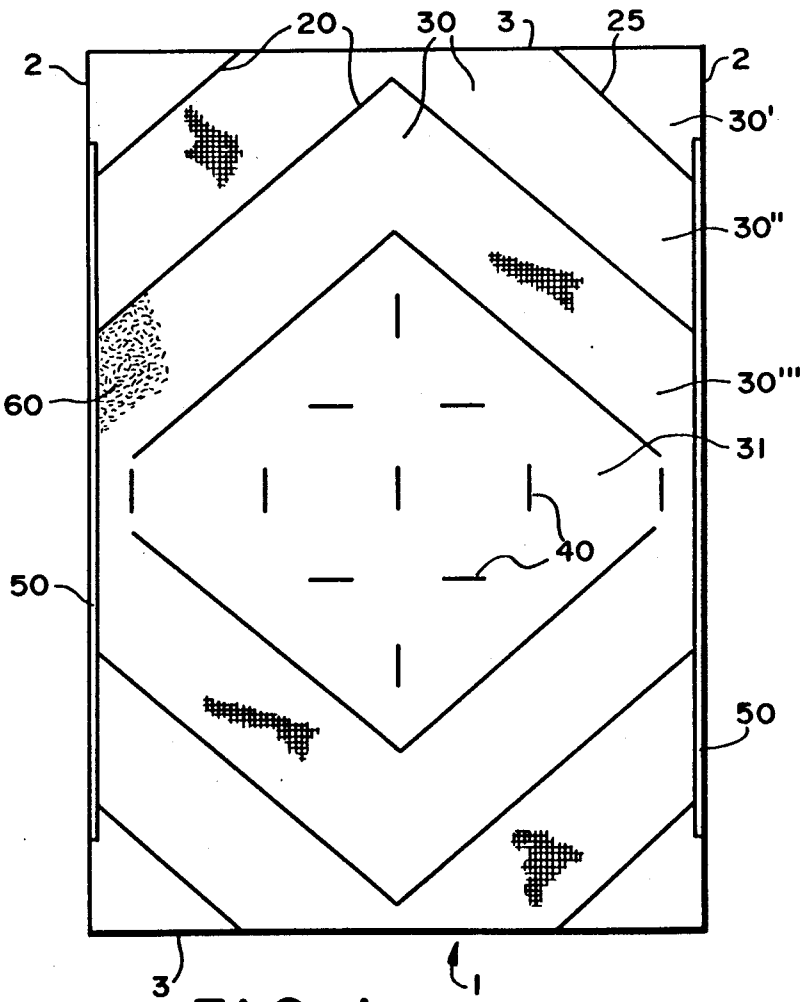
FIG. 1: a top view of a blanket according to a first embodiment.

In FIG. 1 bulging chambers 30 are formed by linear stitchings 20, which form an angle of 45° with the side edges 2 and 3 of the blanket 1, the ends of these chambers diagonally closing the side edges 2 and 3. Triangular chambers 30′ are thereby formed in the corners of the blanket 1. Adjacent thereto, in each case is a second bulging chamber 30″, with a third bulging chamber 30‴ contiguous said second chamber. A relatively large, in this case diamond-shaped chamber 31 is disposed with this third bulging chamber 30‴.

Zippers 50 are sewn in the seam connecting the two sheets of the blanket 1 at both longitudinal edges 2 thereof, these zippers extending over almost the entire length of the side edges 2 of the blanket 1 but at a distance from its corners.

The diagonal arrangement of the bulging chambers 30′ to 30‴ prevent the filling material from being moved into the corners of the blanket 1 through intense movement by the sleeping person.

FIG. 2 shows a cover with bulging chambers 32 formed by stitchings 21, the axis of these chambers being aligned parallel to the transverse edges 3 of the blanket 1. Two such chambers 32 are arranged at one end of the blanket 1, which faces the user's head when in use, whereas there are four chambers 32 at the other end of the blanket 1. A large, rectangular chamber 33 is arranged therebetween, its width corresponding to approximately four times the width of the bulging chambers 32. As a rule this chamber 33 lies on the upper part of a person's body. Shorter stitchings 41, spaced apart from one another, are arranged in this large chamber 33. Some of the shorter stitchings 41 are perpendicular to others.

The blanket 1 according to FIG. 2 has two zippers 51, 52 on only one longitudinal edge 2, these zippers being just large enough that all chambers 32 and 33 can be filled or emptied through them.

Figure 3:
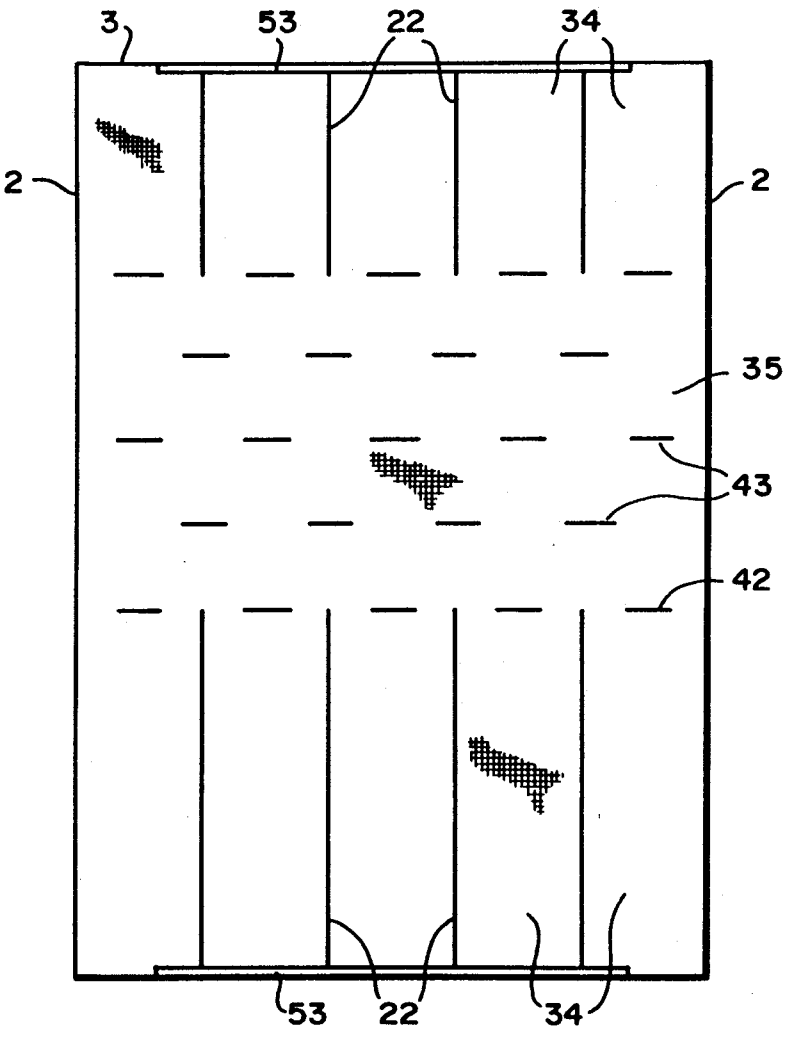
FIG. 3: a top view of a blanket according to a third embodiment.

FIG. 3 shows a blanket 1 in which bulging chambers 34 formed by stitching 22 are formed in the shoulder and arm region (at the top in the drawing) and in the leg and foot region, the longitudinal axis of these chambers being parallel to the longitudinal edges of the blanket 1. Five such chambers 34 are illustrated in this case, however, there can be more.

A large chamber 35, which is open compared to the bulging chambers 34, is arranged between the shoulder and arm region and the leg and foot region. Short stitchings 42 are arranged in the openings of the individual bulging chambers 34, these stitchings closing approximately half of the respective opening and thus separating the bulging chambers 34 from the large chamber 35. Although filling material can reach the large chamber 35 from the bulging chambers 34 and vice-versa, this is relatively difficult.

Short stitchings 43 that are again spaced apart from one another are also arranged in the large chamber of this blanket 1. A zipper 53 through which the bulging chambers 34 can be filled and emptied, is arranged at each of the two transverse edges 3 of the cover 1.

Figure 4:
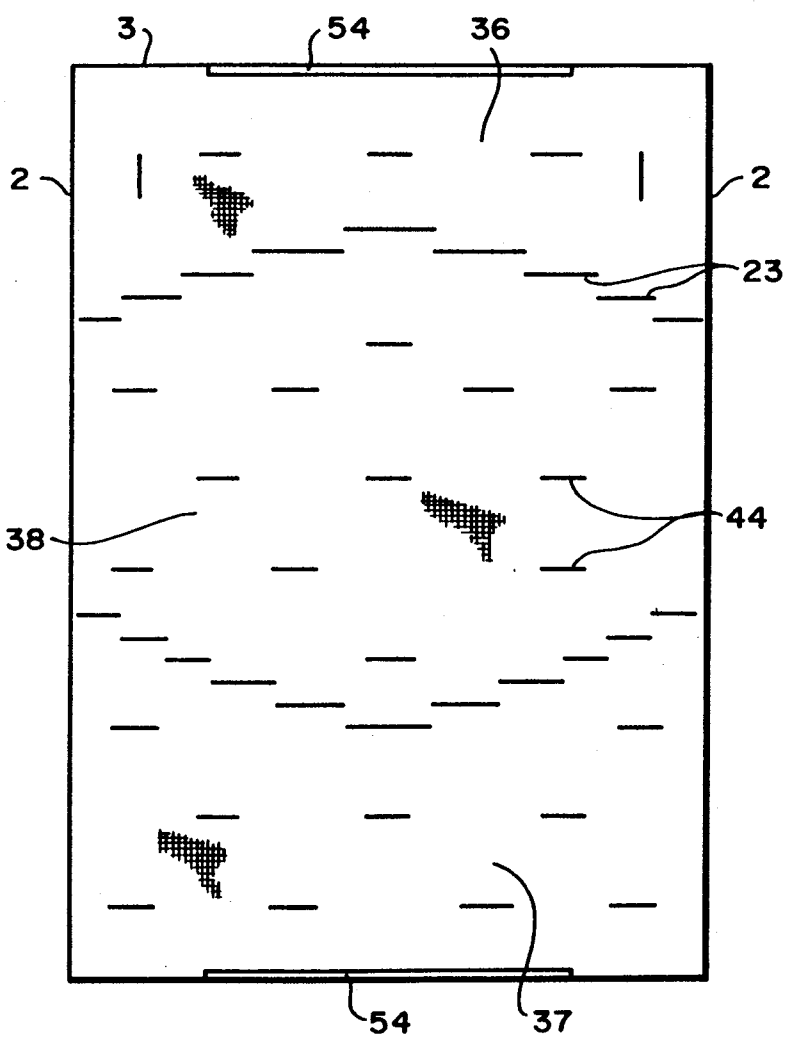
FIG. 4: a top view of a blanket according to a fourth embodiment.

FIG. 4 shows a blanket 1 in which chambers are separated from one another by relatively short stitchings 23 compared to the stitchings described above. In this case also there is a smaller shoulder and arm region (chamber 36 in the drawing, top) and, in comparison, a larger leg and foot region (chamber 37) with an even larger middle area (chamber 38) arranged therebetween. These shorter stitchings are only slightly spaced apart from one another so that relatively little filling material containing aggregates of fiber can penetrate through the chamber boundaries formed thereby.

In addition, shorter stitchings 44 spaced farther apart from one another are arranged in all three chambers 36, 37 and 38. A zipper 54, through which the two chambers 36 and 37 can be filled or emptied, is disposed at each transverse edge 3.

A blanket 1 is manufactured in that a covering with the zippers 50 to 54 is produced and filled with filling material, as indicated in only a small portion of blanket 1 in FIG. 1 at 60 particularly aggregates of spherically wrapped fibers. After the zippers 50 to 54 are closed, the blanket 1 is provided with the stitchings 20 to 23 and 40 to 44 described above. The stitching is thus through the aggregates of fiber which are also stitched. The thermal bridge which usually exists in known quilts is substantially reduced by this.

While the degree of filling of the large chambers 31, 33, 35 and 38 is as a rule no longer changed, the user of the blanket 1 can fill or partially empty the other chambers 30, 32, 34, 36 and 37 in accordance with his wishes and requirements. It is also possible to completely empty one or several chambers, for example during a very hot summer.

Additional filling material can be supplied in casings, such as plastic tubes or the like, whereby these casings filled with refill material can be arranged within the blanket 1, for example in a larger chamber accessible from the outside.

The higher the degree of filling of a chamber, the greater the volume of said chamber and the higher the thermal insulation offered by the blanket. The maximum degree of filling (100%) results when the blanket cannot expand further. During the summer a filling degree of 50 to 70% is as a rule sufficient, whereas during the winter a filling degree of 80 to 100% is felt to be comfortable.

It is possible to fill in even more filling material, but this only increases the weight of the blanket not the thermal insulation.

Moreover, it is possible to fill individual chambers with different filling materials, for example aggregates of fiber made of wool, synthetics, plant or animal fibers. These materials have different properties with respect to the absorption of perspiration which can be utilized purposefully.

As a rule, the shoulder and arm region and the leg and foot region are filled more than the middle region of the blanket. With the blanket 1 according to FIG. 1 the areas in the corners of the blanket can be filled more in order, on the one hand, for the blanket to lie better because of the higher weight and, on the other hand, to better warm the arms and hands or the feet.

With the blanket 1 according to FIG. 3 the middle chamber in the foot region can be filled more, while the two outer chambers are, for example, wrapped around the feet.

To sum up, it can be established that the blanket according to the invention provides a "building block" so that everyone can fill his own personal blanket.

The shorter dot-like stitchings 40 to 44 in chambers 31, 33, 35 and 38 prevent the filling material within the blanket 1 from slipping into regions in which it is not wanted. The aggregates of fiber used adhere slightly to one another, in contrast, for example, to down or feathers, so that it is guaranteed that the blanket is always filled according to the wishes of the user, even in partial areas.

Aggregates of spherically wrapped fibers, which can be used in this blanket, are described, for example, in EP-A-0 257 658 published in the meantime and in EP-A-0 259 730.

It is to be understood that preferred embodiments of the invention have been described above and that further changes and/or modifications can be made without departing from the spirit of the invention as encompassed by the following claims.

What is claimed is:

1. A quilted blanket comprising first and second substantially rectangular covering sheets and a loosely packed filling material made of aggregates of spherically wrapped fibers, said covering including at least one closeable opening through which the covering can be filled with filling material, wherein the opening of the covering can be closed by means of an easily openable fastener and wherein a large chamber is arranged approximately in the middle of the blanket in which spaced, dot-like stitchings, spaced far apart from another, are arranged, said stitchings forming differently shaped chambers in the blanket.

2. A blanket according to claim 1 wherein the large chamber is diamond-shaped.

3. A blanket according to claim 1 wherein the chambers are joined to one another, but are only restricted by dot-like stitchings lying in one line.

4. A blanket according to claim 1 wherein a plurality of chambers in the blanket have different degrees of filling.

5. A blanket according to claim 4 wherein individual chambers are empty.

6. A blanket according to claim 1 wherein a plurality of chambers in the blanket are filled with different filling material.

7. A blanket according to claim 1 wherein each individual chamber is provided with an associated opening.

8. A blanket according to claim 1 wherein said blanket includes a peripheral seam and said at least one closeable opening is arranged in said peripheral seam.

9. A blanket according to claim 1 wherein said at least one closeable opening is arranged in a longitudinal end of the blanket.

* * * * *